United States Patent [19]

Kunczynski

[11] 4,363,945

[45] Dec. 14, 1982

[54] CABLE DERAILMENT RESPONSIVE APPARATUS

[76] Inventor: Jan K. Kunczynski, 2400 Arrowhead Dr., Carson City, Nev. 89701

[21] Appl. No.: 207,259

[22] Filed: Nov. 17, 1980

[51] Int. Cl.[3] ..... H01H 35/00

[52] U.S. Cl. ..... 200/61.18; 104/173 R; 340/675

[58] Field of Search ..... 200/61.18, 61.19; 340/675, 676, 677, 668, 568; 104/173 R, 173 ST

[56] References Cited

U.S. PATENT DOCUMENTS

| | | | |
|---|---|---|---|
| 2,913,712 | 11/1959 | Lee | 340/568 |
| 3,822,369 | 7/1974 | Kunczynski | 200/61.08 |
| 4,019,002 | 4/1977 | Kunczynski | 200/61.18 |

*Primary Examiner*—A. T. Grimley
*Assistant Examiner*—Morris Ginsburg
*Attorney, Agent, or Firm*—Manfred M. Warren; Robert B. Chickering; Glen R. Grunewald

[57] ABSTRACT

A cable derailment responsive apparatus for use in terminating the operation of a cable drive for a chairlift, ski lift, gondola or the like is disclosed. The apparatus includes a spring biasing a portion of the pulley assembly for movement if the cable jumps the sheaves, further includes an electrical circuit having a plug-in connector that is mechanically pulled apart from the remainder of the circuit upon cable derailment to interrupt or deactivate the cable drive. Upon remounting of the cable on the sheave assemblies, the connector can be plugged back into the circuit to permit driving of the cable.

10 Claims, 6 Drawing Figures

CABLE DERAILMENT RESPONSIVE APPARATUS

BACKGROUND OF THE INVENTION

Chair lifts, gondolas, tramways, and the like all employ an endless cable supported for movement over a multiplicity of pulleys, which in turn are supported from towers. One of the most serious safety hazards in connection with such cable-based conveying systems is the possibility that the cable will become derailed from the various pulleys or sheaves and cause the chair, gondola, tram, etc. to fall to the ground with resultant injury to passengers.

While most cable-based conveying systems have cable catcher structures, it is important to be able to terminate or shut down the cable drive mechanism immediately in the event of derailment of the cable from the pulley assemblies. One approach to this problem is shown in my prior U.S. Pat. No. 3,822,369 in which a frangible cable sensing device is placed proximate a pulley assembly in a position at which a derailed cable would cause rupture of the sensor and accordingly automatic shut down of the cable drive apparatus.

Another approach to this problem is shown in my U.S. Pat. No. 4,019,002 in which relatively low inertia movable portions of the pulley assembly are biased by spring means for movement in the event of derailment of the cable. The apparatus further includes means for sensing movement of the low inertia portion of the pulley assembly. Upon derailment of the cable from the pulley assembly, the low inertia pulley mounting elements pivot and this pivotal motion is sensed and used to shut down operation of the pulley drive apparatus.

While the apparatus of my U.S. Pat. No. 4,019,002 had many advantages over the frangible sensor approach of my earlier patent, that part of the sensing apparatus which was responsive to movement of the low inertia portion of the pulley assembly had certain inherent disadvantages. My prior system employed elongated tendons which were mounted over pulleys or spools to transmit motion to a central sensing switch. Under some conditions, the tendon support pulleys could become frozen or require protective coverings to shield the same from ice. Additionally, my prior system had a certain inherent complexity of components which added to manufacturing, installation and adjustment costs.

to provide a cable derailment shut down apparatus which may be used for terminating the operation of drive means for a moving cable and which has improved reliability of operation.

Another object of the present invention is to provide a cable derailment responsive apparatus that has a minimum number of components and may be readily adapted for use with existing cable conveying systems.

Still a further object of the present invention is to provide a cable derailment responsive apparatus which can be used to terminate the operation of drive means for a moving cable that is vibration and fatigue resistant, is not influenced by adverse weather conditions, and is easy to monitor and maintain.

The cable derailment responsive apparatus of the present invention has other objects and features of advantage, some of which will be set forth in more detail in or will become apparent from the following description of the preferred embodiment and the accompanying drawing.

SUMMARY OF THE INVENTION

The cable derailment apparatus of the present invention is used to terminate the operation of drive means for a moving cable supported upon a pulley assembly in the event of derailment of the cable from the pulley assembly. The pulley assembly includes a low inertia mounting means movably mounted (pivoted) to a support for the pulley assembly. The derailment responsive apparatus includes spring biasing means coupled to the movable mounting means to bias the movable mounting means to a moved position upon derailment of the cable from the pulley assembly. The derailment responsive apparatus also includes deactivation means connected to the movable mounting means and formed to cause termination of movement of the cable upon pivoting of the mounting means to the moved position.

The improvement in the cable derailment responsive apparatus of the present invention is comprised, briefly, of the deactivation means including an electrical circuit having a circuit interrupting portion, and connector means coupled to the circuit interrupting portion and connected to transmit motion from the pulley mounting means to the circuit interrupting portion. The connector means is further formed to break the electrical circuit at the circuit interrupting portion upon movement of the mounting means to a moved position. In the preferred form, the circuit interrupting portion is provided by mating, plug-in electrical couplers with one of the couplers being connected to the end of a tension spring providing the biasing force. Upon contraction of the tension spring, the couplers are separated to open or interrupt or break the electrical circuit and terminate operation of the cable drive means.

DESCRIPTION OF THE PREFERRED EMBODIMENT

Figure 1:
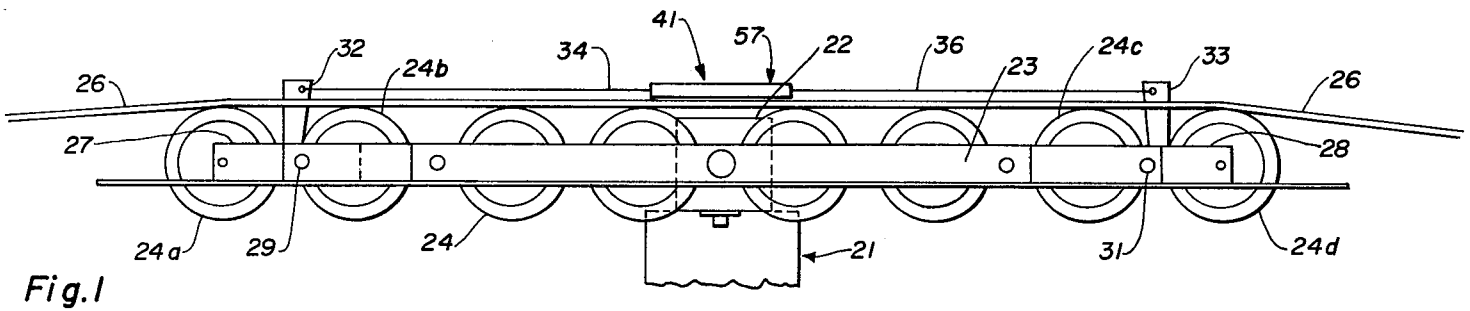
FIG. 1 is a fragmentary, side elevational view of a pulley assembly having the cable derailment responsive apparatus of the present invention mounted thereto and an endless cable supported thereon.

The cable derailment responsive apparatus of the present invention is particularly well-suited as a safety device for cable-based conveying systems such as are employed in the skiing industry. Such systems typically employ a plurality of towers 21 spaced periodically along the path of the conveyor. Each of towers 21 normally includes a laterally extending arm 22 from which a frame work 23 is supported. Rotatably mounted to frame work 23 are a plurality of pulleys or sheaves 24 forming a pulley assembly on which cable 26 is movably supported. The details of construction of the pulley assembly are set forth in my prior U.S. Pat. No.

4,019,002 and will not be repeated herein. The assembly, however, does include a plurality of pivotal mounting yokes that enable the automatic adjustment of the pulleys or sheaves to conform to and evenly support cable 26 to thereby minimize any tendency for the cable to derail from the pulley assembly.

Figure 3:
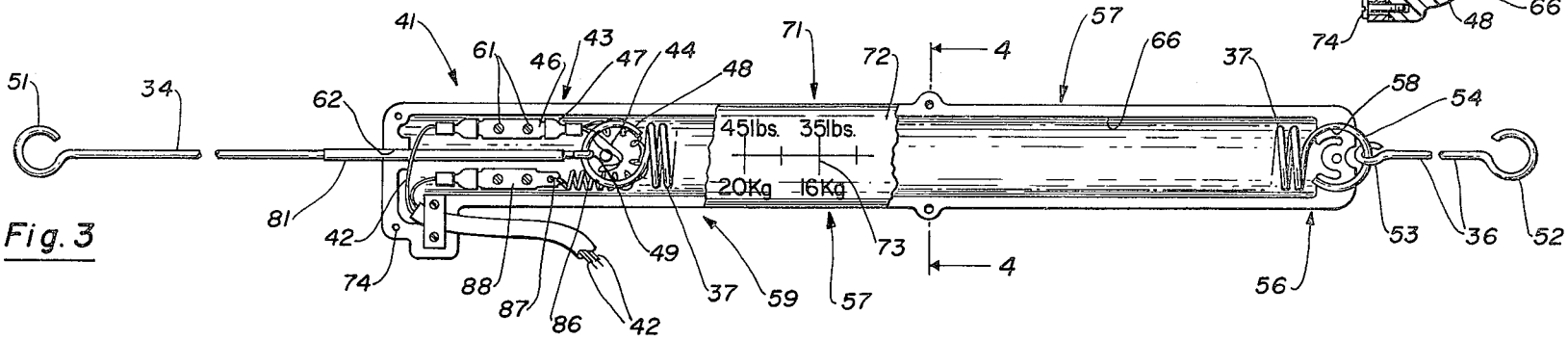
FIG. 3 is an enlarged side elevational view in cross-section of a cable derailment responsive apparatus constructed in accordance with the present invention.

As is described in my prior U.S. Pat. No. 4,019,002, the outermost pulleys 24*a*, 24*b*, 24*c* and 24*d* are mounted to yokes 27 and 28 that in turn are pivoted about axles 29 and 31 to the remainder of frame 23. The small outer yokes 27 and 28 provide relatively low inertia mounting means for the outermost pairs of pulleys. Mounted to the inside of sheaves 24 on the low inertia yokes 27 and 28 are upstanding cable catchers 32 and 33. As was the case in connection with my prior U.S. Pat. No. 4,019,002, the cable derailment responsive apparatus of the present invention employs cable catchers 32 and 33 as lever arms by which a torque can be applied to yokes 27 and 28 that will tend to cause pivoting of the yokes about axles 29 and 31. Such a torque may be applied to the low inertia mounting means or yokes 27 and 28 through cables 34 and 36 that are loaded in tension by spring biasing means, such as a tension spring 37 (FIG. 3), as will be described in more detail below.

When cable 26 is movably supported on the pulley assembly, the weight of the cable and personnel conveying chairs or gondolas will maintain the low inertia mounting yokes 27 and 28 in the position shown in FIG. 1. In the event of derailment of the cable from the pulley assembly, the tension force in cables 34 and 36 will cause movement or pivoting of mounting yokes 27 and 28 to the moved positions shown in FIG. 2. In my prior U.S. Pat. No. 4,019,002, the tendons or cables 34 and 36 were mounted around guide rollers or pulleys to a central sensing apparatus positioned over the tower. The sensing apparatus included a switch assembly so that movement of the low inertia mounting means would be transmitted through the tendon used to bias the mounting yokes to a switch device, which was interposed in the electrical circuit controlling operation of cable drive means for the cable. While the system of my prior U.S. Pat. No. 4,019,002 was found to have many advantages over the frangible sensor of my prior U.S. Pat. No. 3,822,369, I have discovered certain improvements which greatly enhance the reliability, simplicity, and economics of manufacture, installation and maintenance.

Figure 2:
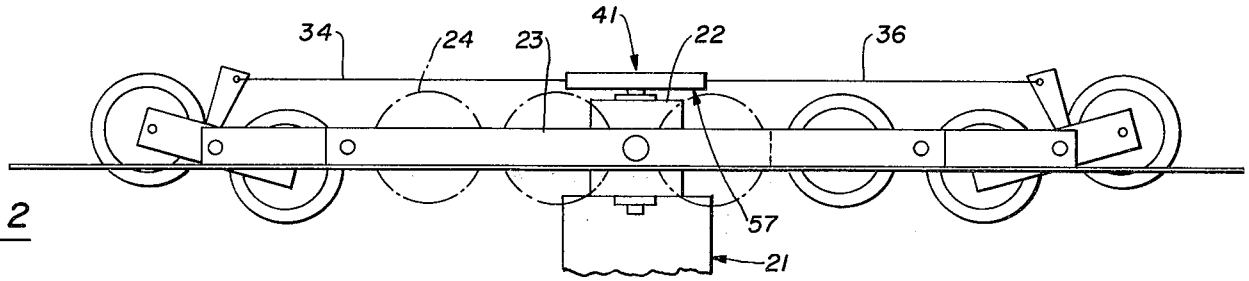
FIG. 2 is a fragmentary, side elevational view corresponding to FIG. 1 with the cable being derailed and the pulley assembly in a moved position.

In the cable derailment responsive apparatus of the present invention termination of the operation of a cable drive means (not shown) is again accomplished by employing a deactivation means that is connected to a low intertia mounting means for the pulleys, such as yokes 27 and 28, and is formed to terminate operation of the cable drive upon pivoting or movement of the yokes to the position of FIG. 2.

The improvement in the cable derailment responsive apparatus is comprised of forming the deactivation means, generally designated 41, to include an electrical circuit 42 having a circuit interrupting portion, generally designated 43, and further providing the deactivation means with connector means 44 coupled to circuit interrupting portion 43 and connected to transmit motion from low inertia mounting means 27 to circuit interrupting portion 43. Moreover, connector means 44 is formed to mechanically interrupt or break the electrical circuit at the circuit interrupting portion 43 upon movement of the mounting means to the moved position shown in FIG. 2.

Figure 5:
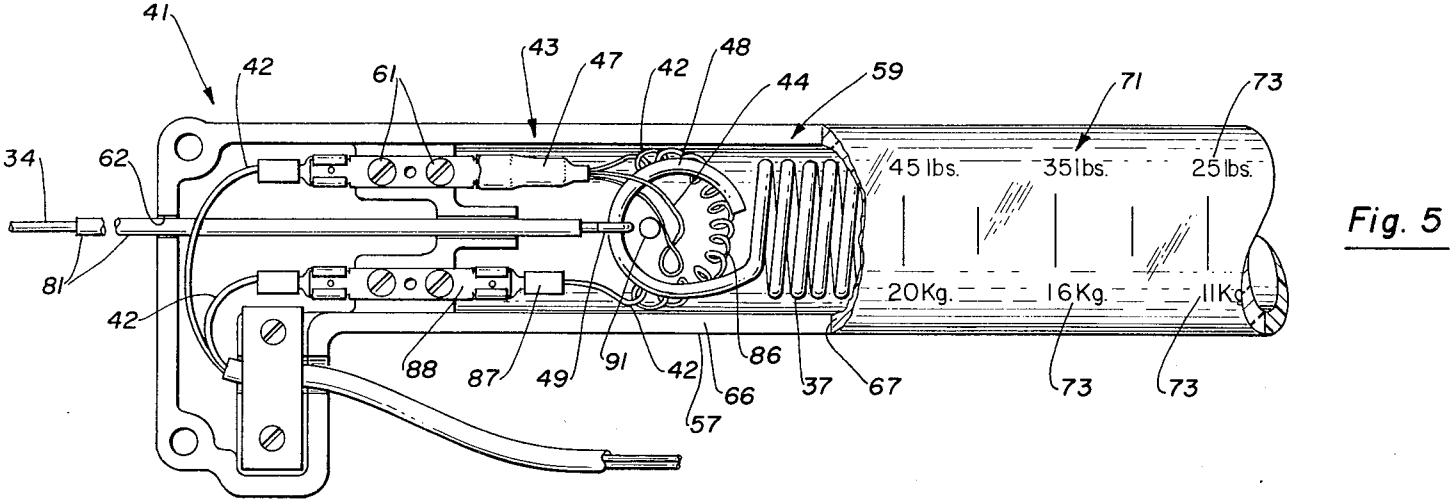
FIG. 5 is a fragmentary, enlarged view corresponding to FIG. 3 showing a closed electrical circuit.
Figure 6:
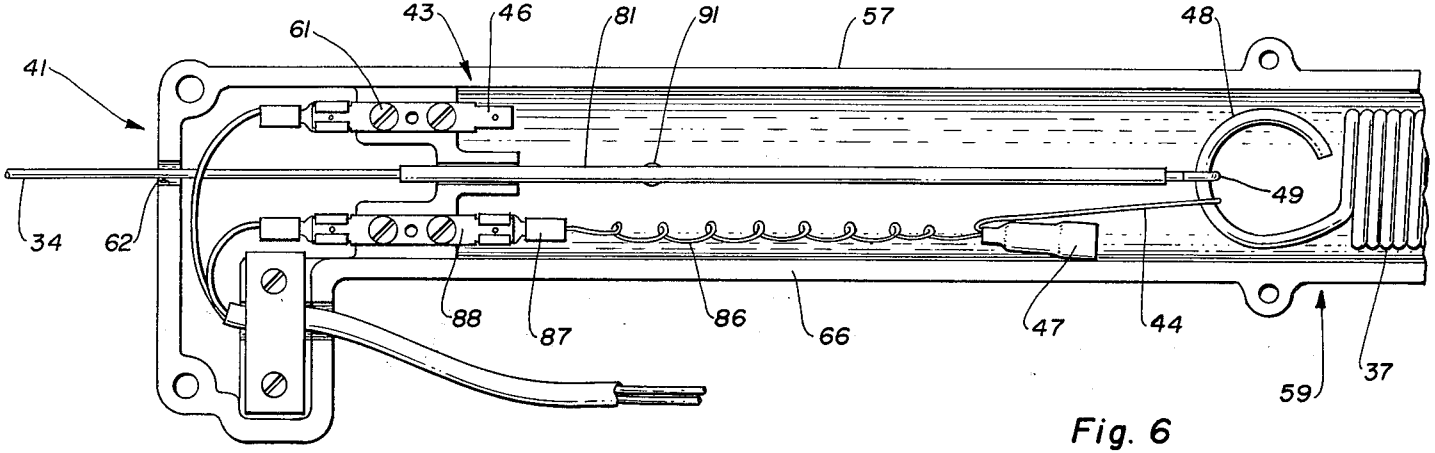
FIG. 6 is a fragmentary, enlarged view corresponding to FIG. 3 showing a moved position and an open electrical circuit.

In the preferred form of the invention, the circuit interrupting portion 43 is provided by a pair of separable electrical couplers, such as a mating male electrical coupler 46 and female electrical coupler 47 (see FIGS. 5 and 6). The connector 44 is connected to one of the couplers, in this case female coupler 47, and further extends around hook or eyelet 48 on the end of tension spring 37. Hook or eyelet 48 on the end of the tension spring is also coupled to a hook or eyelet 49 on the end of tendon or cable 34 or on the end of a connecting rod that is coupled to cable 34. The opposite end of cable 34 is coupled by a hook or eyelet 51 (FIG. 3) to the upstanding cable catcher element 32 on low inertia mounting yoke 27. In the preferred form an intermediate connecting rod between cable 34 and spring 37 is used for ease of coupling the deactivation means to the cables 34 and 36. The opposite end of tension spring 37 and cable shut down means 41 is supported in a manner which will be described in more detail hereinafter.

In operation, tension spring 37 applies a tension force to yoke 27 through tendon or cable 34. In the event of derailment of the conveying cable 26 from pulleys 24*a* and 24*b*, the tension in tendon 34 will cause rotation of mounting yoke 27 about axle 29, which in turn will allow tension spring 37 to contract. As the tension spring contracts, the eye 48 will reach the end of the looped connector 44 and apply an axial force to the connector in a direction separating the plug-in electrical couplers 46 and 47. As shown in FIG. 6, this causes a mechanical breaking of the electrical circuit that immediately deactivates or terminates operation of the cable drive mechanism so that motion of conveying cable 26 is terminated.

It is a feature of the present invention that connector 44 be formed with lost motion means, such as a loop, which passes over hook or eye 48 of the tension spring. The loop allows axial contraction of tension spring 37 through some relatively small distance before applying a mechanical separating force to the circuit interrupting portion 43 of the electrical circuit. Thus, minor pivoting of the yoke, as will be common during normal floating or rocking of the yoke under dynamic loads and when the cable grip passes over pulleys 24*a* and 24*b*, will not cause separation of electrical couplers 46 and 47.

In the preferred form of the cable derailment responsive apparatus of the present invention, deactivation means 41 is coupled at its opposite end to tendon or cable 36, which in turn is connected to cable catcher element 33 on low inertia yoke 28. Thus, as best may be seen in FIG. 3, tendon or cable 36 is provided with an eyelet 52 that is connected to cable catcher 33 and a second eyelet 53 which is coupled to an eyelet or hook 54 at the end of tension spring 37. Tension spring 37, therefore, is used to tension both cables 34 and 36 and will cause rotation of both low inertia yokes to the moved position of FIG. 2 upon derailment of the cable. Instead of passing the cable over pulleys or spools to a central sensing apparatus, however, the deactivation means 41 is simply interposed between cables 34 and 36, with the cables being coupled to opposite ends of the deactivation apparatus.

In order to protect the apparatus of the present invention from malfunctioning as a result of the adverse environment and further to provide a support permitting mechanical separation of the plug-in type couplers, a first end 56 of tension spring 37 is also secured to a housing 57 surrounding the deactivation means. This may be accomplished by passing eyelet 54 through a mating channel 58 in the end of housing 57. Thus, cable 36 is in effect coupled simultaneously to first end 56 of tension spring 37 and to housing 57. By contrast, a second end 59 of tension spring 37 is free for axial movement with respect to housing 57. Moreover, the male electrical coupler 46 is secured by fasteners 61 to housing 57 while cable or tendon 34 extends out through an opening or passageway 62 dimensioned to permit free sliding movement of cable 34 with respect to the housing.

When either or both of the mounting yokes pivots upon derailment of the cable, therefore, second end 59 will contract within housing 57 and eye 48 will pull upon connector 44 in a direction tending to pull female electrical coupler 47 away from male coupler 46. Since the male coupler is secured to coupler 47 by fasteners 61, the movement of second end 59 of the tension spring inside the housing will produce a break or opening of the electrical circuit at circuit interruption portion 43.

In order to facilitate installation and maintenance, there is a further feature of the present invention to provide the housing 57 with indicator means, generally designated 71, that is formed to visually indicate the approximate spring biasing force applied by tension spring 37 through tendons 34 and 36 to the pivotal mounting yokes. This can be accomplished in a number of different manners, but in the preferred form housing 57 is formed as two housing halves 66 and 67 which are releasably secured together by fasteners 74 or the like. Housing half 66 has a spring 37 secured thereto, while housing half 67 is transparent and acts as a cover. Outside surface 72 of transparent housing half 67 is formed with indicator means or a scale 71 in which indicia 73 are axially spaced along the housing at locations corresponding to the amount of tension in spring 37 when the end of eyelet 48 is proximate the indicia. The end 48 of the spring can be visually checked through transparent cover 67 to determine the approximate tension force in cables 34 and 36.

In order to enable visual inspection of the derailment responsive apparatus to the present invention, it is further an important feature to provide indicator means such as indicia 81, which is formed to visually indicate when the eyelet 48 on second end 59 of the spring has contracted or moved to a position which is proximate the end of the range of motion which would start to produce separation of the electrical couplers 46 and 47. Thus, when eyelet 48 has moved away from the circuit breaker portion 43 to the point that it will begin engaging the loop 44, there is very little motion which can be tolerated from pivotally mounted yokes 27 and 28 without breaking the electrical circuit.

One way of indicating that the spring has contracted to a point at which breaking of the circuit is possible is to provide indicia 81 as a colored piece of shrink tubing mounted coaxially cable 34, or a connecting rod between the cable and the spring, and extending out through opening 62 in the housing. The axial position of tube 81 on cable 34 can be arranged so that as long as the colored tube 81 extends out of housing 57 the inspector will know that spring 37 is extended sufficiently to permit some play or rocking of the mounting yokes without breaking of the circuit. If tubing 81 disappears inside opening 62, the eyelet 48 will be dangerously close to eliminating all of the slack in connection means 44 and pulling the plug-in couplers apart.

The electrical circuit in deactivation means 41 preferably includes an axially expandable section 86, such as a coil of electrically conducting wire, which is connected to coupler 47. In the event of cable derailment, the spring 37 will pull electrical couplers 46 and 47 apart as the spring contracts inside housing 57. The expansible conductor wire section 86 allows the circuit breaker portion 43 to be pulled apart by connector 44 to the position of FIG. 6 without also pulling end 87 from conductor 88, which forms a portion of the electrical circuit. Thus, the electrical circuit is maintained intact at all position except circuit portion 43, and it is a relatively simple matter to reconnect the electrical circuit upon mounting of the cable back on to the pulley assembly. The remounting of the cable on the pulley assembly will extend spring 37, and one need only remove cover 67 and plug the coupler 47 back onto electrical coupler 46, with the extensible section 86 of the electrical circuit automatically contracting.

Figure 4:
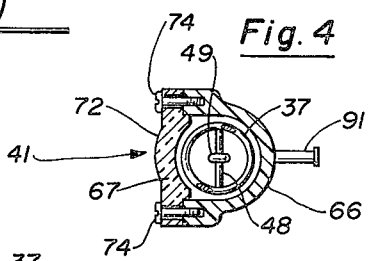
FIG. 4 is a cross-sectional view taken substantially along the plane of line 4—4 in FIG. 3.

In order to facilitate mounting of the deactivation device of the present invention to the pulley assemblies, spring detention means, preferably in the form of a pin 91 mounted to housing 57 of lateral reciprocation to a position behind hook 48 is provided. Thus, the deactivation device can be cocked by extending spring 37 until hook 48 is past pin 91. The pin can be reciprocated into the housing to support the spring load, and the device can now be attached to cables 34 and 36 while cocked. This allows the slack to be removed from the cables without having to fight spring 37. Once the slack is removed, pin 91 can be reciprocated out from behind hook 48 to the position shown in FIG. 4, and the force in spring 37 transmitted to cables 34 and 36.

What is claimed is:

1. A cable derailment responsive apparatus for use in terminating the operation of cable drive means for a moving cable supported upon a pulley assembly upon derailment of the cable from the pulley assembly, said pulley assembly including mounting means movably mounted to support means and carrying pulley means thereon; and said derailment responsive apparatus including spring biasing means coupled to said mounting means to bias said mounting means to a moved position upon derailment of said cable from said pulley assembly, and deactivation means connected to said mounting means and formed to terminate operation of said cable drive means upon movement of said mounting means to said moved position, said deactivation means including an electrical circuit having a circuit interrupting portion, and connector means coupled to said circuit interrupting portion and connected to transmit motion from said mounting means to said circuit interrupting portion, wherein the improvement in said cable derailment responsive apparatus is comprised of:

said circuit interrupting portion being provided by a pair of mechanically separable electrical couplers, and said connector means being connected to one of said couplers to transmit motion thereto in a direction causing separation of said couplers to mechanically open said electrical circuit upon movement of said mounting means to said moved position.

2. The cable derailment responsive apparatus as defined in claim 1 wherein, said electrical couplers are formed as mating male and female elements, and said connector means is formed with lost motion means permitting some movement of said mounting means before said motion is transmitted to said couplers.

3. The cable derailment responsive apparatus as defined in claim 1 wherein, said spring biasing means is a tension spring; and said connector means is coupled to one of said couplers and is coupled to said tension spring to transmit motion of said tension spring to cause separation of said couplers.

4. The cable derailment responsive apparatus as defined in claim 3 wherein, said connector means is coupled between said tension spring and one of said couplers by loop means formed to permit relative movement between said tension spring and said one of said couplers before causing separation of said couplers.

5. The cable derailment responsive apparatus as defined in claim 1 wherein, said couplers are provided by a pair of mating plug-in electrical couplers;

said connector means is coupled to one of said electrical couplers and is formed to permit movement of said spring biasing means over a range of motion without separating said electrical couplers; and indicator means formed to visually indicate when said spring biasing means has moved to a position proximate the end of said range of motion which would produce separation of said electrical couplers.

6. The cable derailment responsive apparatus as defined in claim 5, and said deactivation means includes tendon means connected between said mounting means and said spring biasing means; wherein the further improvement comprises:

said indicator means is provided by indicia on said tendon means.

7. The cable derailment responsive apparatus as defined in claim 1, and said electrical circuit further includes an axially expandable section formed to permit mechanical separation of said circuit interrupting portion while maintaining said electrical circuit intact at positions other than said circuit interrupting portion.

8. The cable derailment responsive apparatus as defined in claim 1 wherein, said deactivation means includes a housing having a transparent section superimposed over said spring biasing means, and indicia means on said housing positioned at axial locations along said housing corresponding to locations at which said spring biasing means applied a known axial force to a tendon means connected to said spring biasing means.

9. The cable derailment responsive apparatus as defined in claim 1, and spring detention means movably mounted to a housing of said deactivation means for lateral reciprocation between a position behind and engaging an end of said spring biasing means when extended and a position free of said spring biasing means to enable selective cocking and release of said spring biasing means.

10. A cable derailment responsive apparatus for use in terminating the operation of cable drive means for a moving cable supported upon a pulley assembly upon derailment of the cable from the pulley assembly, said pulley assembly including a pair of relatively spaced apart mounting means movably mounted to support means and each carrying pulley means thereon; and said derailment responsive apparatus including a tension spring, a pair of tendon means coupled to each of said mounting means and coupled to opposite ends of said tension spring to bias each of said mounting means to a moved position upon derailment of said cable from said pulley means and deactivation means connected to each of said mounting means and formed to terminate operation of said cable drive means upon movement of one of said mounting means to said moved position, said deactivation means including an electrical circuit having a circuit interrupting portion, and connector means coupled to said circuit interrupting portion and connected to transmit motion from said mounting means to said circuit interrupting portion to mechanically open said electrical circuit at said circuit interrupting portion upon movement of said one of said mounting means to said moved position, wherein the improvement in said apparatus is comprised of:

said deactivating means including a housing mounted around said tension spring and said circuit interrupting portion being mounted inside said housing; and said tendon means being unsupported between said mounting means and said tension spring for suspension of said tension spring, housing and circuit interrupting portion between said mounting means by said tendon means.

* * * * *

UNITED STATES PATENT AND TRADEMARK OFFICE

CERTIFICATE OF CORRECTION

PATENT NO. : 4,363,945
DATED : December 14, 1982
INVENTOR(S) : Jan K. Kunczynski It is certified that error appears in the above-identified patent and that said Letters Patent are hereby corrected as shown below:

Col. 1, line 20 from bottom of page insert ---Accordingly, it is an object of the present invention---.

Signed and Sealed this

*Twenty-second* Day of *February 1983*

[SEAL]

*Attest:*

GERALD J. MOSSINGHOFF

*Attesting Officer*

*Commissioner of Patents and Trademarks*